US011965396B1

(12) United States Patent
Xiao et al.

(10) Patent No.: US 11,965,396 B1
(45) Date of Patent: Apr. 23, 2024

(54) THRUST FORCE TO OPERATE CONTROL VALVE

(71) Applicant: SAUDI ARABIAN OIL COMPANY, Dhahran (SA)

(72) Inventors: Jinjiang Xiao, Dhahran (SA); Songlin Zhong, Dhahran (SA); Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 25 days.

(21) Appl. No.: 18/046,750

(22) Filed: Oct. 14, 2022

(51) Int. Cl.
*E21B 34/14* (2006.01)
*E21B 43/12* (2006.01)
(Continued)

(52) U.S. Cl.
CPC ..... *E21B 34/14* (2013.01); *E21B 43/128* (2013.01); *E21B 43/35* (2020.05); *E21B 33/12* (2013.01)

(58) Field of Classification Search
CPC ..... E21B 34/14; E21B 43/35; E21B 43/128; E21B 33/12
See application file for complete search history.

(56) References Cited

U.S. PATENT DOCUMENTS 5,070,944 A 12/1991 Hopper
6,113,675 A * 9/2000 Branstetter ..... B01D 19/0052 96/196
(Continued)

FOREIGN PATENT DOCUMENTS

EP 2554786 A1 2/2013
WO 2016050301 A1 4/2016

OTHER PUBLICATIONS

"Specification for Subsurface Safety Valve Equipment", American Petroleum Institute; API Specification 14A; Twelfth Edition; Jan. 2015 (150 pages).

*Primary Examiner* — Taras P Bemko
(74) *Attorney, Agent, or Firm* — Osha Bergman Watanabe & Burton LLP

(57) ABSTRACT

A system includes an electric submersible pump assembly and a control valve assembly. The electric submersible pump assembly transports a fluid in a casing string of a well to a surface location and includes a pump that receives the fluid through a pump intake and vents the fluid through a pump discharge when activated. The electric submersible pump assembly further includes a shaft that is fixed to the pump and extends downhole from the pump. The control valve assembly includes a propeller shaft axially movable along a central axis of the system, a propeller attached to the propeller shaft that pushes the propeller shaft downhole when the pump of the electric submersible pump assembly is active, a shaft coupler that connects the propeller shaft and the shaft of the electric submersible pump assembly, and a stinger that has a conduit for the fluid to flow from the casing string to the pump intake. The stinger includes an entrance for receiving the fluid and an exit for venting the fluid to the pump intake of the electric submersible pump assembly. In addition, the control valve assembly includes a flow tube, connected to the propeller shaft, and a spring. The flow tube includes ports which create fluid communication between the flow tube and the stinger when the ports and the entrance of the stinger are aligned. The spring slides the propeller shaft when the pump of the electric submersible pump assembly is inactive.

20 Claims, 7 Drawing Sheets

(51) Int. Cl.
*E21B 43/34* (2006.01)
*E21B 33/12* (2006.01)

(56) References Cited

U.S. PATENT DOCUMENTS 6,253,843 B1 7/2001 Rawson et al.
8,038,120 B2 10/2011 Vick et al.
8,453,748 B2 6/2013 Vick et al.
8,464,799 B2 6/2013 Scott et al.
8,919,730 B2 12/2014 Vick
10,174,589 B2 1/2019 Vick et al.
10,670,160 B2 6/2020 Phelps
10,927,643 B2 2/2021 Ejim et al.
2004/0173362 A1 9/2004 Waithman et al.
2005/0092501 A1* 5/2005 Chavers ..... E21B 34/10 166/386
2005/0095156 A1* 5/2005 Wolters ..... E21B 34/101 417/555.1
2008/0302987 A1* 12/2008 Corriveau ..... A01G 25/162 239/69
2010/0019182 A1* 1/2010 Maercovich ..... F16K 31/3855 251/242
2012/0032964 A1* 2/2012 Lippincott ..... G06F 9/5011 345/502
2012/0199367 A1 8/2012 Bouldin et al.
2013/0175042 A1 7/2013 Scott et al.
2014/0000870 A1 1/2014 Vick et al.
2015/0118067 A1 4/2015 Childs et al.
2017/0211352 A1* 7/2017 Arraour ..... F04D 13/10
2018/0128083 A1* 5/2018 Lastra ..... E21B 23/001
2019/0162063 A1* 5/2019 Brown ..... F04D 13/10
2019/0264518 A1* 8/2019 Al-Gouhi ..... E21B 34/066
2020/0256159 A1 8/2020 Vick et al.
2023/0279753 A1* 9/2023 Artinian ..... E21B 31/00 166/301

* cited by examiner

THRUST FORCE TO OPERATE CONTROL VALVE

BACKGROUND

In the oil and gas industry, hydrocarbons are located in reservoirs far beneath the Earth's surface. Wells are drilled into these reservoirs to produce said hydrocarbons. The structure of a well is made of a plurality of casing strings cemented in place. A production string is set within the innermost casing string. The production string is used to provide a conduit for production fluids, such as hydrocarbons, to flow from the reservoir to the surface of the Earth. The production string is made of production tubing and downhole production equipment. A subsurface safety valve (SSSV) is frequently installed as part of the production tubing to aid in well control.

A SSSV is a valve that is designed to shut off flow, through the production tubing, in a well control scenario. A SSSV may be deep-set or shallow-set. A deep-set SSSV is set downhole from the downhole production equipment. Thus, when a tool needs to be run into the production tubing to workover the downhole production equipment, a conduit, such as wireline, does not need to pass through the deep-set SSSV. However, a deep-set SSSV leaves a significant volume of hydrocarbons between the deep-set SSSV and the surface which creates more operational risk. A shallow-set SSSV is set much closer to the surface, above the downhole production equipment. However, the shallow-set SSSV must be designed in a way to shut off flow when a conduit is run through the production tubing.

SUMMARY

In one aspect, embodiments of the present invention relate to a system comprising an electric submersible pump assembly and a control valve assembly. The electric submersible pump assembly transports a fluid in a casing string of a well to a surface location and includes a pump that receives the fluid through a pump intake and vents the fluid through a pump discharge when activated. The electric submersible pump assembly further includes a shaft that is fixed to the pump and extends downhole from the pump. The control valve assembly includes a propeller shaft axially movable along a central axis of the system, a propeller attached to the propeller shaft that pushes the propeller shaft downhole when the pump of the electric submersible pump assembly is active, a shaft coupler that connects the propeller shaft and the shaft of the electric submersible pump assembly, and a stinger that has a conduit for the fluid to flow from the casing string to the pump intake. The stinger includes an entrance for receiving the fluid and an exit for venting the fluid to the pump intake of the electric submersible pump assembly. In addition, the control valve assembly includes a flow tube, connected to the propeller shaft, and a spring. The flow tube includes ports which create fluid communication between the flow tube and the stinger when the ports and the entrance of the stinger are aligned. The spring slides the propeller shaft when the pump of the electric submersible pump assembly is inactive.

In one aspect, embodiments of the present invention relate to a method comprising connecting a propeller shaft of a control valve assembly and a shaft of an electric submersible pump assembly by a shaft coupler, rotating a propeller by a fluid travelling upwards towards a surface location upon activation of a pump of the electric submersible pump assembly, thereby thrusting the propeller shaft axially downhole along a central axis, and aligning ports of a flow tube with an entrance of a stinger, thereby permitting fluid communication between the flow tube and the stinger. The method further includes receiving the fluid through the entrance of the stinger, venting the fluid through an exit of the stinger to a pump intake of the electric submersible pump assembly, venting the fluid to a surface location by a pump discharge of the electric submersible pump assembly subsequent to receiving the fluid through the pump intake, and sliding the propeller shaft by a spring upon deactivation of the pump, thereby misaligning the ports of the flow tube and the entrance of the stinger.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems and methods of operating a control valve assembly by utilizing a thrust force. The systems and methods include an ESP assembly that includes a pump, a pump intake, a pump discharge, and a shaft. The systems and methods also include a control valve assembly formed of a propeller shaft, a propeller, a shaft coupler, a stinger, a flow tube, and a spring. The techniques discussed in this disclosure are beneficial in reducing sand accumulation within ESP systems and simplify operational deployment and retrieval challenges associated with cable deployed ESP systems.

Figure 1:
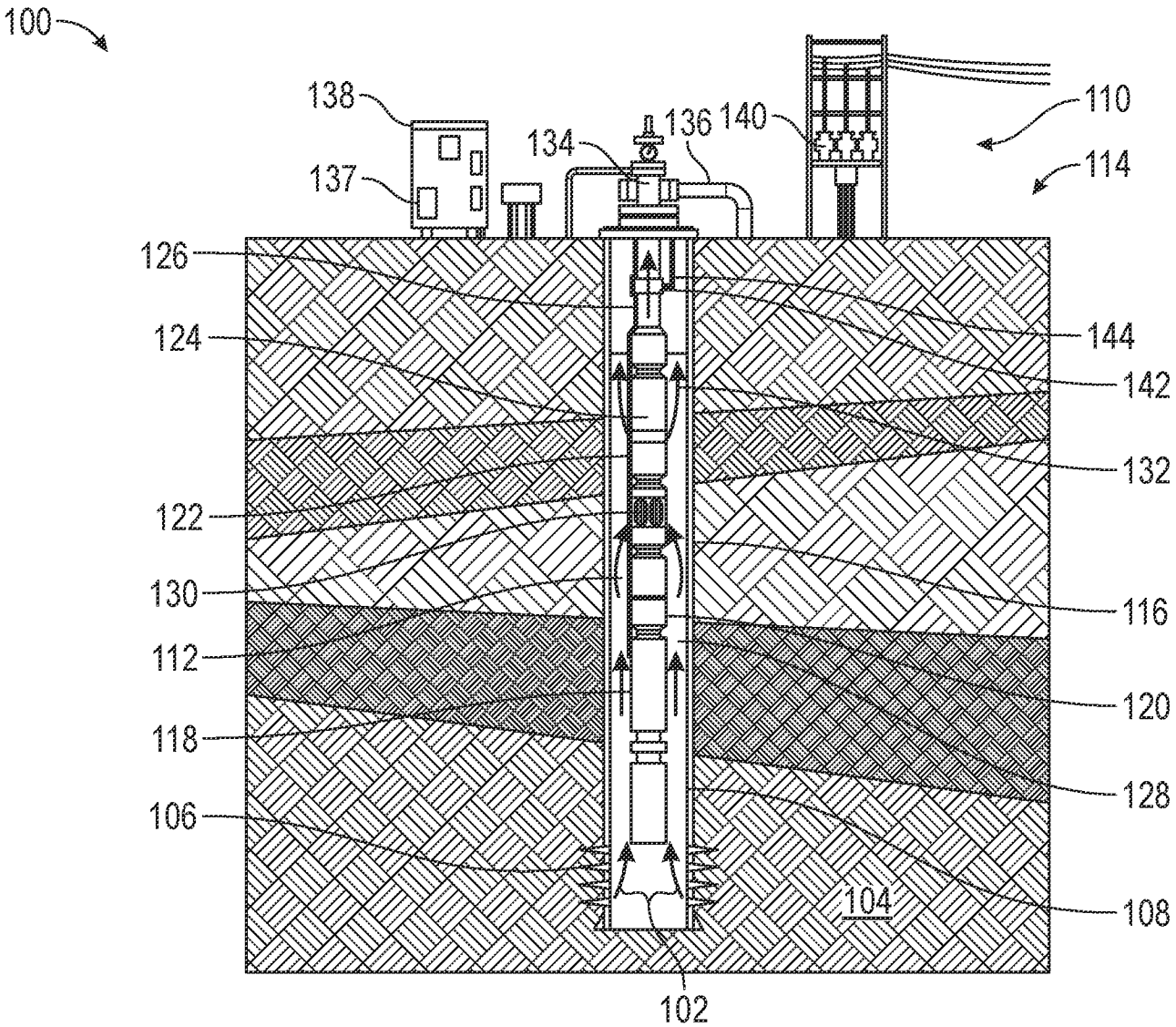
FIG. 1 shows an exemplary well with an Electrical Submersible Pump (ESP) completion design in accordance with one or more embodiments.

FIG. 1 shows an exemplary ESP system (100). The ESP system (100) is used to help produce fluids (102) from a formation (104). Perforations (106) in the well's (116) casing string (108) provide a conduit for the fluid (102) to enter the well (116) from the formation (104). The ESP system (100) includes surface equipment (110) and an ESP string (112). The ESP string (112) is deployed in a well (116) and the surface equipment (110) is located at a surface location (114). The surface location (114) is any location outside of the well (116), such as the Earth's surface.

The ESP string (112) may include a motor (118), motor protectors (120), a gas separator (122), a multi-stage centrifugal pump (124) (herein called a "pump"(124)), and an electrical cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of fluid (102) from the bottom of the well (116) to the surface location (114). The motor (118) is cooled by the fluid (102) passing over the motor (118) housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) may be located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from the fluid (102). The seals further equalize the pressure in the annulus (128) with the pressure in the motor (118). The annulus (128) is the space in the well (116) between the casing string (108) and the ESP string (112). The pump intake (130) is the section of the ESP string (112) where the fluid (102) enters the ESP string (112) from the annulus (128).

The pump intake (130) is located above the motor protectors (120) and below the pump (124). The depth of the pump intake (130) is designed based off of the formation (104) pressure, estimated height of the fluid (102) in the annulus (128), and optimization of pump (124) performance. If the fluid (102) has associated gas, then a gas separator (122) may be installed in the ESP string (112) above the pump intake (130) but below the pump (124). The gas separator (122) removes the gas from the fluid (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the fluid (102) to the surface location (114). The pump (124) has a plurality of stages that are stacked upon one another. Each stage contains a rotating impeller and stationary diffuser. As the fluid (102) enters each stage, the fluid (102) passes through the rotating impeller to be centrifuged radially outward gaining energy in the form of velocity. The fluids (102) enter the diffuser, and the velocity is converted into pressure. As the fluid (102) passes through each stage, the pressure continually increases until the fluid (102) obtains the designated discharge pressure and has sufficient energy to flow to the surface location (114). The ESP string (112) outlined in FIG. 1 may be described as a standard ESP string (112), however, the term ESP string (112) may be referring to a standard ESP string (112) or an inverted ESP string (112) without departing from the scope of the disclosure herein.

In other embodiments, sensors may be installed in various locations along the ESP string (112) to gather downhole data such as pump intake (130) volumes, discharge pressures, and temperatures. The number of stages is determined prior to installation based of the estimated required discharge pressure. Over time, the formation (104) pressure may decrease and the height of the fluid (102) in the annulus (128) may decrease. In these cases, the ESP string (112) may be removed and resized. Once the fluid (102) reaches the surface location (114), the fluid (102) flows through the wellhead (134) into production equipment (136). The production equipment (136) may be any equipment that can gather or transport the fluids (102) such as a pipeline or a tank.

The ESP system (100) may include a sub-surface safety valve (SSSV) (142) installed within the ESP string (112). The SSSV (142) may be installed near the surface location (114). The SSSV (142) is a valve, such as a flapper valve, that may be used to block the fluid (102) from flowing up the ESP string (112) and to the surface location (114). The SSSV (142) may be used as part of the shut-in system of the well (116). In scenarios where the well (116) needs to be shut in, such as for repairs or in an emergency, the SSSV (142) along with other valves located in the wellhead (134) are closed. The SSSV (142) may be controlled using a SSSV control line (144). The SSSV control line (144) may connect the SSSV (142) to a control module at the surface location (114). The SSSV control line (144) may be a conduit for hydraulic fluid. The control module may use the hydraulic fluid, within the SSSV control line (144), to open or close the SSSV (142).

The remainder of the ESP system (100) includes various surface equipment (110) such as electric drives (137), pump control equipment (138), the control module, and an electric power supply (140). The electric power supply (140) provides energy to the motor (118) through the electrical cable (126). The electric power supply (140) may be a commercial power distribution system or a portable power source such as a generator. The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Cable deployed electric submersible pump (CDESP) systems, as one skilled in the art will be aware, are rigless ESP systems (100) that are designed to bring wells (116) on production faster and lower the costs associated with installing and replacing ESP systems (100). CDESP systems feature an inverted ESP system (100) with the motor (118) connected directly to an electrical cable (126) configuration, which improves the overall reliability of the system.

In CDESP systems, a SSSV (142) set below the bottomhole assembly, or a deep-set SSSV (142), may be employed. Drawbacks of the deep-set SSSV (142) may include the requirement of long control lines (144) and the need to replace surface control panels already in place when converting wells (116) from a typical tubing deployed ESP system (100) to a CDESP system because additional power is required in order to operate a deep-set SSSV (142).

An alternative to the deep-set SSSV (142) is a shallow-set SSSV (142). The application of a shallow-set SSSV (142) is complicated by the electrical cable (126) in the production stream, which must seal against the flow of fluid (102) to the surface location (114). In addition, the use of a shallow-set SSSV (142) complicates the deployment and retrieval of the CDESP system, especially under live well (116) conditions. Still, new solutions, which use a CDESP system to operate the SSSV (142) without control lines (144) from the surface location (114) are becoming available. However, these designs suffer from sand production and accumulation issues. Flow tubes and springs of these designs may become jammed by sand disposed within the fluid (102), preventing proper functionality of the SSSV (142).

As such, embodiments disclosed in FIGS. 2-8 present systems (150) and methods of operating a control valve assembly (152) by utilizing a thrust force. In addition, the systems (150) and methods include an ESP assembly (154) composed of a pump (124), a pump intake (130), a pump discharge (156), and a shaft (158). Further, the control valve assembly (152) is formed of a propeller shaft (160), a propeller (162), a shaft coupler (164), a stinger (166), a flow tube (146), and a spring (148). The system (150) prevents sand accumulation, thereby ensuring proper functionality of the control valve assembly (152).

Figure 2:
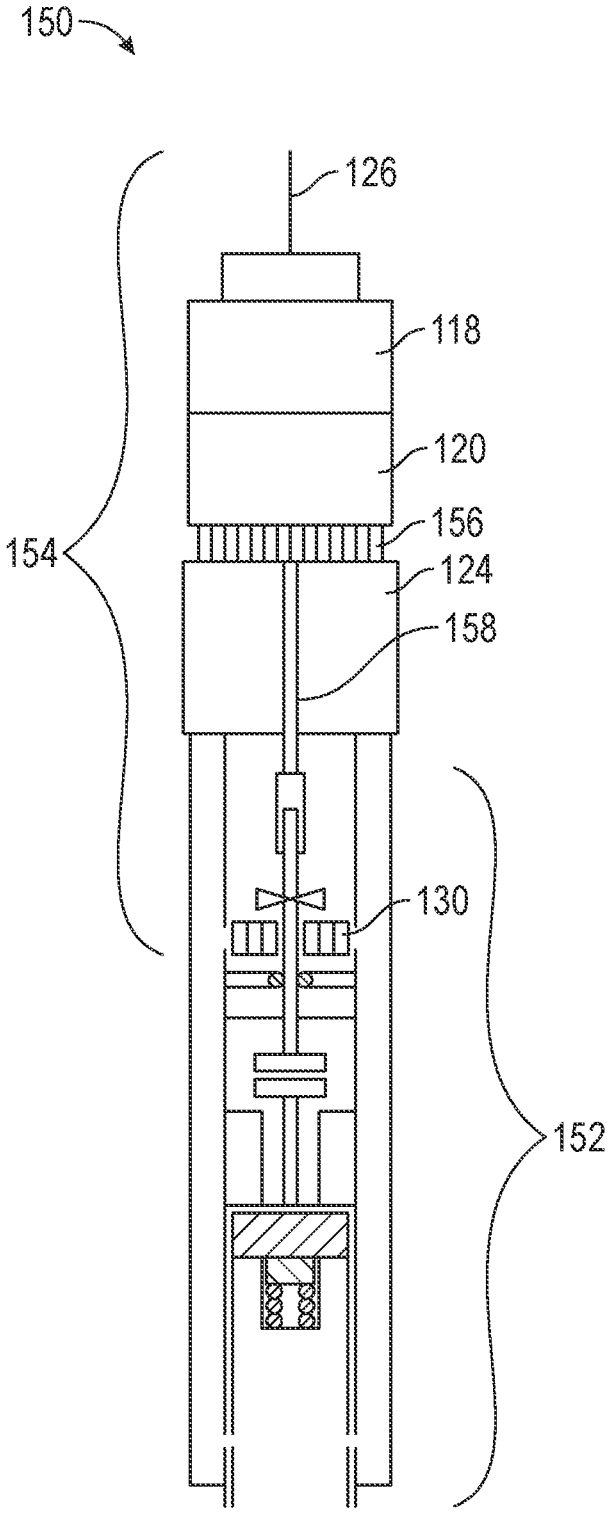
FIG. 2 shows a cross-sectional view of the system in accordance with one or more embodiments of the present disclosure.

FIG. 2 shows a cross-sectional view of the system (150) in accordance with one or more embodiments of the present disclosure. The system (150) includes an ESP assembly (154) and a control valve assembly (152). Here, the ESP assembly (154) is formed of a pump (124), a pump intake (130), a pump discharge (156), and a shaft (158). In this embodiment, the ESP assembly (154) is a CDESP system and includes a motor (118) connected directly to an electrical cable (126) configuration. As described above, when activated, the pump (124) of the ESP assembly (154) receives a fluid (102) disposed in the casing string (108) of the well (116) through the pump intake (130) and vents the fluid (102) through the pump discharge (156) to the surface location (114). The shaft (158) of the ESP assembly (154) is utilized to connect the ESP assembly (154) to the control valve assembly (152). The control valve assembly (152) is disposed downhole of the ESP assembly (154) when the assemblies are joined together. Accordingly, the shaft (158) is formed of a durable material, such as steel, and extends downhole from the pump (124). Further, the shaft (158) is fixed to the pump (124).

Figure 3:
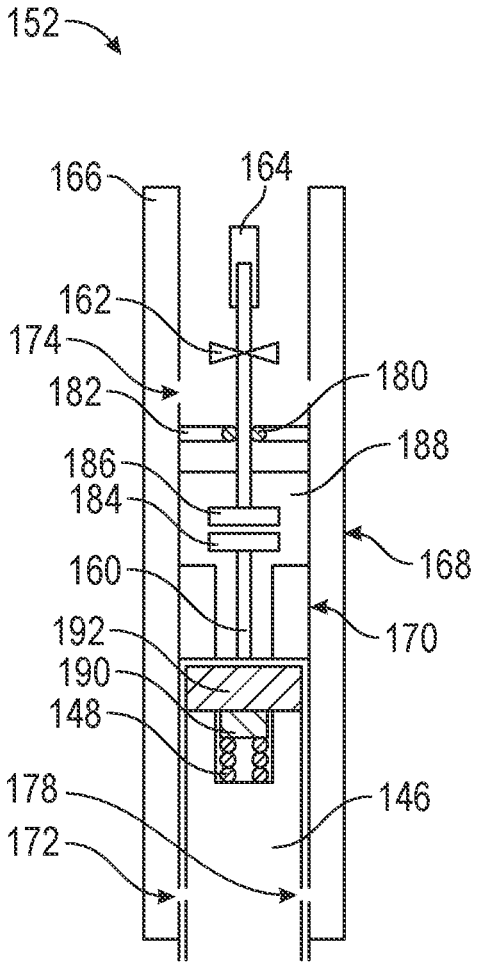
FIG. 3 shows a cross-sectional view of a control valve assembly in accordance with one or more embodiments of the present disclosure.

FIG. 3 shows a cross-sectional view of a control valve assembly (152) in accordance with one or more embodiments of the present disclosure. The control valve assembly (152) includes a propeller shaft (160), a propeller (162), a shaft coupler (164), a stinger (166), a flow tube (146), and a spring (148). The propeller shaft (160) of the control valve assembly (152) is coupled to the shaft (158) of the ESP assembly (154) by the shaft coupler (164). Similar to the shaft (158), both the propeller shaft (160) and shaft coupler (164) are formed of a durable material, such as steel. Further, the shaft coupler (164) permits the propeller shaft (160) to rotate with the shaft (158) of the ESP assembly (154) when the pump (124) is active.

The propeller (162) of the control valve assembly (152) is attached to an upper end of the propeller shaft (160) by way of a splined, keyed, or threaded bore. In this way, the propeller (162) rotates with the propeller shaft (160) and the shaft (158) of the ESP assembly (154). In addition, the propeller motion of the propeller (162) and rotation of the propeller shaft (160) is aided by fluid (102) flowing over the vanes of the propeller (162) while travelling from the pump intake (130) to the pump (124) of the ESP assembly (154). Further, the propeller (162) may be made of a hard material, such as a durable polymer or steel.

The stinger (166) provides a conduit for the fluid (102) to flow from the casing string (108) of the well (116) to the pump intake (130). In this embodiment, the stinger (166) is tubularly shaped and includes an outer wall (168) defined by an outer diameter, an inner wall (170) defined by an inner diameter, and upper and lower surfaces connecting the outer wall (168) and inner wall (170). The conduit of the stinger (166) is disposed between the outer wall (168) and the inner wall (170). In addition, the stinger (166) is formed of steel and further includes an entrance (172) and an exit (174). The entrance (172) is located on the inner wall (170) at a downhole end of the stinger (166). The downhole end of the stinger (166) is an end of the stinger (166) including the lower surface. The entrance (172) is an opening of the stinger (166) which permits the fluid (102) from the casing string (108) of the well (116) to enter the conduit of the stinger (166), while the exit (174) is an opening of the stinger (166) in which the fluid (102) exits the conduit of the stinger (166) to enter the pump intake (130). The exit (174) is also located on the inner wall (170) of the stinger (166). However, the exit (174) is disposed at an upper end of the stinger (166) near the upper surface of the stinger (166). Also, the stinger (166) may be fixed to the ESP assembly (154) by attaching the upper surface of the stinger (166) to the pump (124) and by attaching the inner wall (170) of the stinger (166) to the pump intake (130).

Disposed within an interior of the stinger (166), defined by the space inside the inner wall (170) of the stinger (166), is the flow tube (146) of the control valve assembly (152). A durable material, such as a hard polymer or steel, is used to form the flow tube (146). The flow tube (146) is moveable within the interior of the stinger (166) along a central axis (176) of the system (150) and includes ports (178) that may align with the entrance (172) of the stinger (166). The ports (178) are openings for fluid (102) to flow through. Fluid communication between the stinger (166) and the flow tube (146) is established when the flow tube (146) is moved into a position such that the ports (178) and the entrance (172) of the stinger (166) align. However, when the flow tube (146) is moved into a position such that the ports (178) and entrance (172) do not align, the exterior surface of the flow tube (146) covers the entrance (172) of the stinger (166) such that fluid communication between the stinger (166) and flow tube (146) is lost and fluid (102) from the casing string (108) of the well (116) is unable to enter the stinger (166).

In addition, the control valve assembly (152) includes a spring (148). In this particular embodiment, the spring (148) is a compression spring (148) and may be formed of high-carbon, alloy, or stainless steel. The spring (148) may act upon the downhole end of the propeller shaft (160), thereby moving the propeller shaft (160) axially within the control valve assembly (152) towards the surface location (114).

The control valve assembly (152) may further include a bearing (180), a sand shield (182), a thrust bearing (184), a thrust runner (186), a housing (188), a driving magnetic coupler (190), and a driven magnetic coupler (192). The bearing (180) of the control valve assembly (152) may be, but is not limited to, a ball bearing or a tapered roller bearing. The propeller shaft (160) is disposed within the bearing (180). The bearing (180) supports the propeller shaft (160) radially within the control valve assembly (152) while simultaneously permitting the propeller shaft (160) to rotate. In this embodiment, the bearing (180) is connected to the propeller shaft (160) downhole of the propeller (162). Further, the bearing (180) may also be fixed to the interior of the stinger (166) by a support or a sand shield (182). The sand shield (182) is designed to prevent sand or debris disposed within the fluid (102) from reaching and potentially damaging the thrust bearing (184) and the thrust runner (186), as the trust bearing (184) and the thrust runner (186) require a clean, uncontaminated oil or fluid to ensure proper operation. The sand shield (182) may be a disk disposed between the bearing (180) and the interior of the stinger (166) or a tube disposed at the entrance (172) or the exit (174) of the stinger (166). In these positions, the sand shield (182) prevents sand from accessing the housing (188), which encloses the thrust bearing (184) and the thrust runner (186).

The thrust bearing (184) and the thrust runner (186), as one skilled in the art will be aware, are utilized to support the propeller shaft (160) axially within the control valve assembly (152). While only one thrust bearing (184) and one thrust runner (186) are depicted in FIG. 3, a multitude of thrust bearings (184) and thrust runners (186) may be employed along the propeller shaft (160) for additional axial support. Similarly, multiple bearings (180) may be employed for additional radial support.

The housing (188) of the control valve assembly (152) is disposed within the interior of the stinger (166) and may be rigidly fixed to the inner wall (170) of the stinger (166). The housing (188) encloses a portion of the propeller shaft (160) that includes the downhole end of the propeller shaft (160), the thrust bearing (184), and the thrust runner (186). Additionally, the spring (148) is disposed within the downhole end of the housing (188). The housing (188) may be formed of a durable material such as steel or a hard polymer. The structure of the housing (188) is further detailed in FIG. 4, which shows a cross-sectional view of a housing (188) in accordance with one or more embodiments of the present disclosure.

A driving magnetic coupler (190) may be attached to the downhole end of the propeller shaft (160). In this instance, a driven magnetic coupler (192), magnetically attracted to the driving magnetic coupler (190), is fixed within an interior of the flow tube (146). The driving magnetic coupler (190) and the driven magnetic coupler (192) are complementary shaft couplings that utilize a magnetic field to transmit a non-contact axial force upon one another. In this way, the driving magnetic coupler (190) and the driven magnetic coupler (192) couple the propeller shaft (160) and the flow tube (146). That is, the driving magnetic coupler (190) and the driven magnetic coupler (192) cause the flow tube (146) to mirror the axial movement of the downhole end of the propeller shaft (160), without rotating the flow tube (146).

Figure 4:
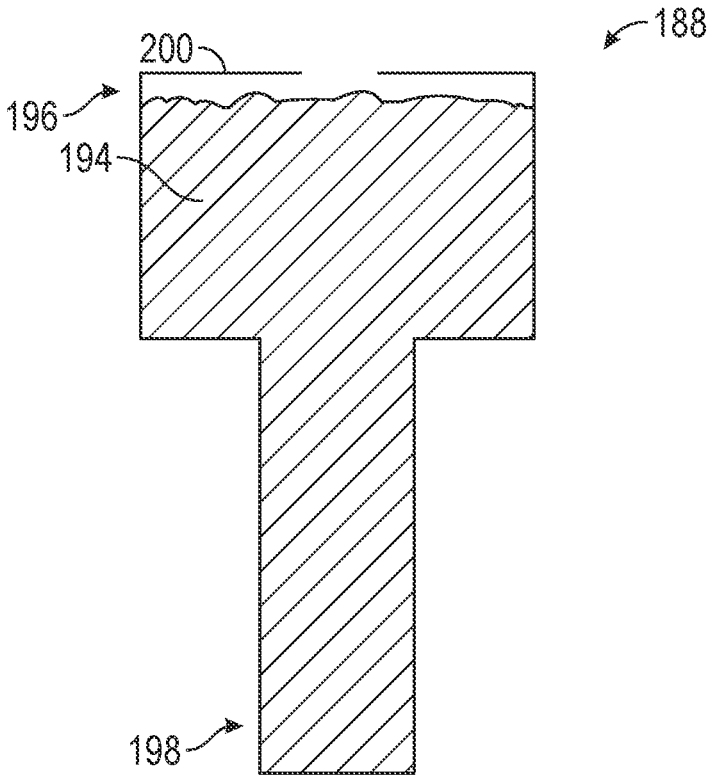
FIG. 4 shows a cross-sectional view of a housing in accordance with one or more embodiments of the present disclosure.

FIG. 4 shows a housing (188) in accordance with one or more embodiments of the present disclosure. As mentioned previously, the housing (188) encloses components of the control valve assembly (152) and is disposed within the interior of the stinger (166). Additionally, the housing (188) may include a barrier fluid (194). The barrier fluid (194) is employed to provide lubrication to components disposed within the housing (188) and may fully fill an interior of the housing (188). The housing (188) further includes a first end (196) and a second end (198). A diameter of the first end (196) may be greater than a diameter of the second end (198). In this instance, the first end (196) is fixed to the inner wall (170) of the stinger (166), while the second end (198) does not contact the stinger (166). The spring (148) of the control valve assembly (152) is fixed within the interior of the housing (188) at the second end (198) of the housing (188).

Disposed at the first end (196) of the housing (188) is a top surface (200) of the housing (188) that includes an opening for the propeller shaft (160) to pass through. In this way, a portion of the propeller shaft (160) that includes the downhole end of the propeller shaft (160) may be enclosed within the housing (188). A seal may be disposed at the opening to prevent the barrier fluid (194) from escaping the housing (188). Further, a thrust bearing (184) may be disposed at the opening to guide the propeller shaft (160) to provide additional support.

The housing (188) may further enclose the driving magnetic coupler (190), as the driving magnetic coupler (190) may be fixed to the downhole end of the propeller shaft (160). In addition, the driving magnetic coupler (190) may be in contact with an upper end of the spring (148).

Figure 5:
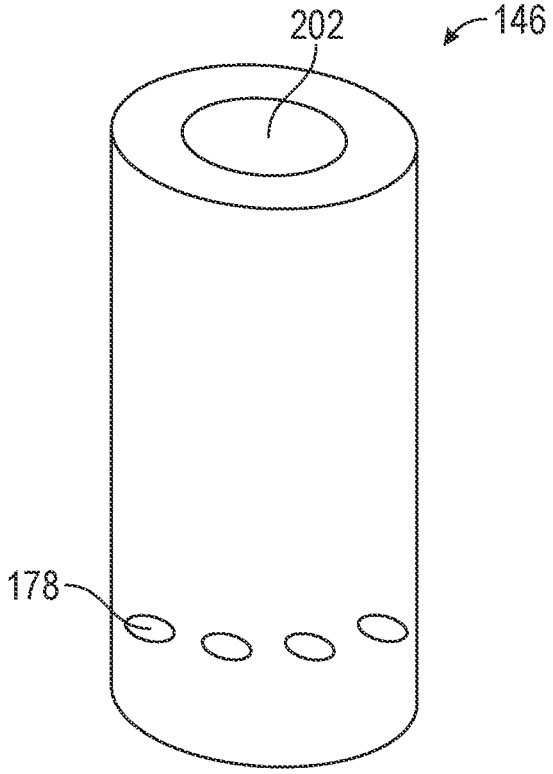
FIG. 5 shows a flow tube in accordance with one or more embodiments of the present disclosure.

FIG. 5 shows a flow tube (146) in accordance with one or more embodiments of the present disclosure. The flow tube (146) is tubularly shaped. Similar to the housing (188), an upper surface of the flow tube (146) includes an aperture (202). The aperture (202) of the flow tube (146) permits the flow tube (146) to slide axially along the second end (198) of the housing (188). A driven magnetic coupler (192) may be fixed within the flow tube (146) at an upper end of the flow tube (146). The driven magnetic coupler (192) is disk shaped and also includes an opening for the second end (198) of the housing (188) to pass through. Accordingly, the driven magnetic coupler (192) is magnetically attracted to the driving magnetic coupler (190) disposed within the housing (188), thereby coupling the flow tube (146) and the propeller shaft (160). Therefore, the driving magnetic coupler (190) and the driven magnetic coupler (192) cause the flow tube (146) to mirror the axial movement of the downhole end of the propeller shaft (160). In this way, as the propeller shaft (160) slides axially within the control valve assembly (152), the driven magnetic coupler (192), and thus the flow tube (146), slide a similar distance and direction along the second end (198) of the housing (188). In addition, as the flow tube (146) slides along the second end (198) of the housing (188) within the interior of the stinger (166), the ports (178) of the flow tube (146) may align and misalign with the entrance (172) of the stinger (166), thereby establishing and breaking fluid communication, respectively, between the flow tube (146) and the conduit of the stinger (166).

Figure 6A:
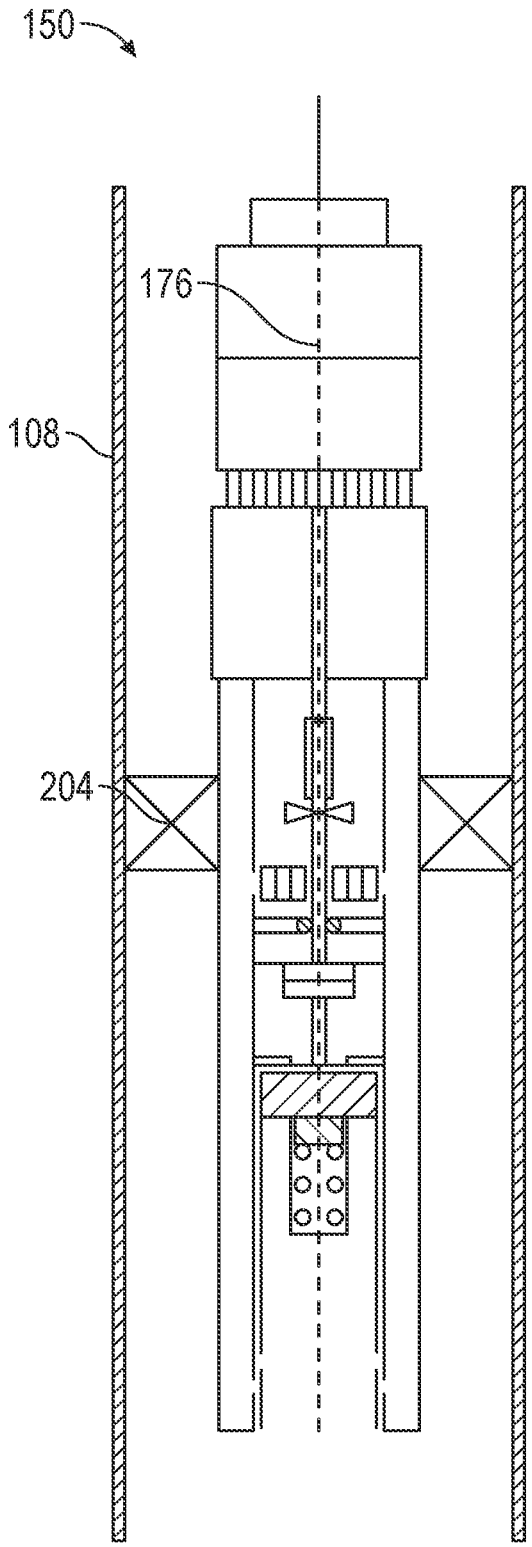
FIGS. 6A and 6B show diagrams depicting the operational sequence of the system in accordance with one or more embodiments of the present disclosure.
Figure 6B:
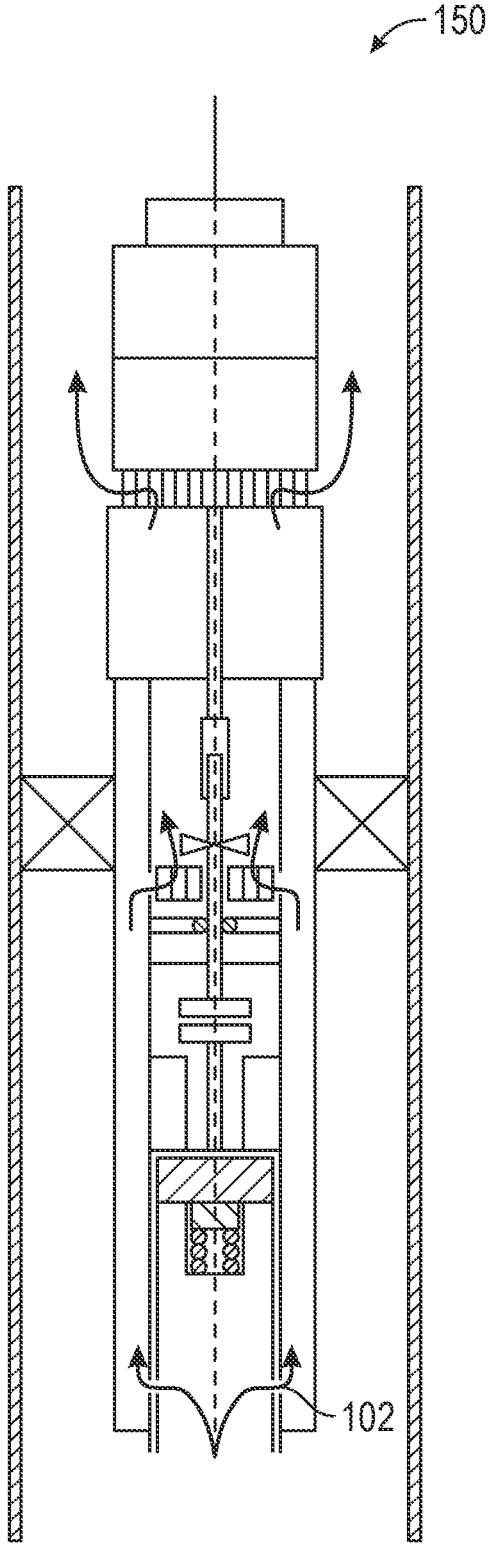

FIGS. 6A and 6B show diagrams depicting the operational sequence of the system (150) in accordance with one or more embodiments of the present disclosure. FIG. 6A shows the system (150) when the pump (124) of the ESP assembly (154) is inactive. Here, the spring (148) of the control valve assembly (152) is expanded and applies a force upwards upon the driving magnetic coupler (190), and thus the propeller shaft (160). Consequently, the flow tube (146) is situated such that the ports (178) of the flow tube (146) and the entrance (172) of the stinger (166) are not aligned. In the embodiment shown, the ports (178) of the flow tube (146) are located above the entrance (172) of the stinger (166) in this position. In addition, the downhole end of the flow tube (146) covers the entrance (172) of the stinger (166), thereby preventing fluid (102) disposed in the casing string (108) of the well (116) from entering the conduit of the stinger (166) through the entrance (172). However, fluid (102) may be disposed within the system (150) during installation, while the system (150) is lowered within the well (116), prior to a packer (204) of the system (150) being set. The fluid (102) may enter the system (150) through the pump discharge (156) of the ESP assembly (154) and occupy regions of the control valve assembly (152) up hole from the housing (188).

FIG. 6B shows the system (150) when the pump (124) of the ESP assembly (154) is active. When the pump (124) is activated, the fluid (102) disposed within the control valve assembly (152) above the housing (188) flows upwards to the pump (124). As the shaft (158) of the ESP assembly (154) rotates, so does the propeller shaft (160) and the propeller (162). Consequently, a downward force is generated by the propeller (162) as the propeller (162) rotates, thereby thrusting the propeller shaft (160) downhole within the control valve assembly (152). As the propeller shaft (160) travels axially downhole, the upper end of the propeller shaft (160) disposed within the shaft coupler (164) slides downhole within the shaft coupler (164). Similarly, when the pump (124) is inactive and the spring (148) forces the propeller shaft (160) upwards, the upper end of the propeller shaft (160) slides upwards within the shaft coupler (164).

Further, while the propeller shaft (160) is thrusted downhole by the propeller (162), components of the control valve assembly (152) fixed to the propeller shaft (160), such as the propeller (162) and the driving magnetic coupler (190), are also forced downhole. Therefore, as the driving magnetic coupler (190) travels downhole within the housing (188), the driven magnetic coupler (192), and thus the flow tube (146), travel downhole along the second end (198) of the housing (188) within the interior of the stinger (166). The spring (148), situated at the downhole end of the second end (198) of the housing (188), is compressed as the propeller shaft (160) and the driving magnetic coupler (190) are forced downhole. In addition, the spring (148) limits the downhole axial movement of the propeller shaft (160) and the driving magnetic coupler (190).

When the spring (148) is fully compressed, the flow tube (146) is positioned within the stinger (166) such that the ports (178) of the flow tube (146) align with the entrance (172) of the stinger (166). In this position, the conduit of the stinger (166) and the flow tube (146) are in fluid communication. The fluid (102) disposed in the casing string (108) of the well (116), downhole of the control valve assembly (152), may enter the system (150) through the downhole end of the flow tube (146). A suction force produced by the pump (124) of the ESP assembly (154) causes the fluid (102) disposed within the flow tube (146) to travel through the ports (178) of the flow tube (146) and the entrance (172) of the stinger (166), upwards within the conduit of the stinger (166), and out the exit (174) of the stinger (166) to the pump intake (130). From the pump intake (130), the fluid (102) flows upwards through the pump (124) to the pump discharge (156). The pump discharge (156) then vents the fluid (102) into the casing string (108) of the well (116) causing the fluid (102) to travel upwards within the casing string (108) to the surface location (114) to be produced.

In addition, the system (150) may further comprise a packer (204). The packer (204) creates a seal between the outer wall (168) of the stinger (166) and the casing string (108) in order to provide isolation between the fluid (102) entering the pump intake (130) of the ESP assembly (154) and the fluid (102) exiting the pump discharge (156). In this way, the packer (204) prevents fluid recirculation within the system (150).

Figure 7:
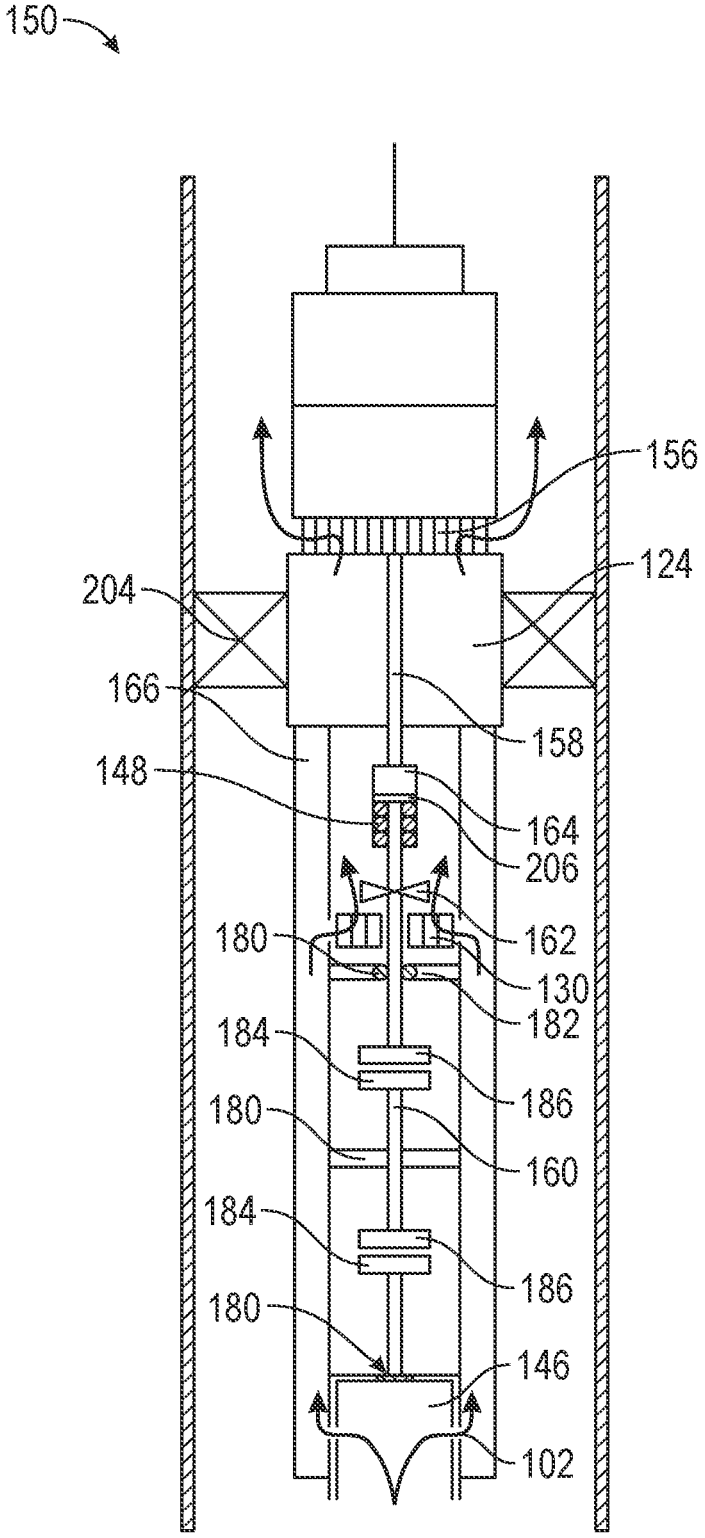
FIG. 7 shows a cross-sectional view of the system in accordance with one or more embodiments of the present disclosure.

FIG. 7 shows a cross-sectional view of the system (150) in accordance with one or more embodiments of the present disclosure. In this embodiment, the spring (148) of the control valve assembly (152) is disposed within the shaft coupler (164) and fixed to the downhole end of the shaft coupler (164). The propeller shaft (160) passes through the shaft coupler (164), while a cap (206) of the propeller shaft (160), which has a diameter greater than an internal diameter of the spring (148), is situated above the spring (148). The cap (206) is fixed to the upper end of the propeller shaft (160) and compresses the spring (148) when the pump (124) of the ESP assembly (154) is active and the propeller (162) forces the propeller shaft (160) downwards within the control valve assembly (152).

In addition, in this embodiment, the flow tube (146) may be connected to the propeller shaft (160) by a bearing (180) disposed in the aperture (202) of the flow tube (146). In this way, the propeller shaft (160) may move the flow tube (146) axially, without rotating the flow tube (146). Further, the control valve assembly (152) may include additional bearings (180), thrust bearings (184), and thrust runners (186). The additional bearings (180) may connect to the inner wall (170) of the stinger (166) and the propeller shaft (160) by a support that does not include a sand shield (182). Also, in this embodiment, the packer (204) may be displaced between the pump (124) of the ESP assembly (154) and the casing string (108).

Figure 8:
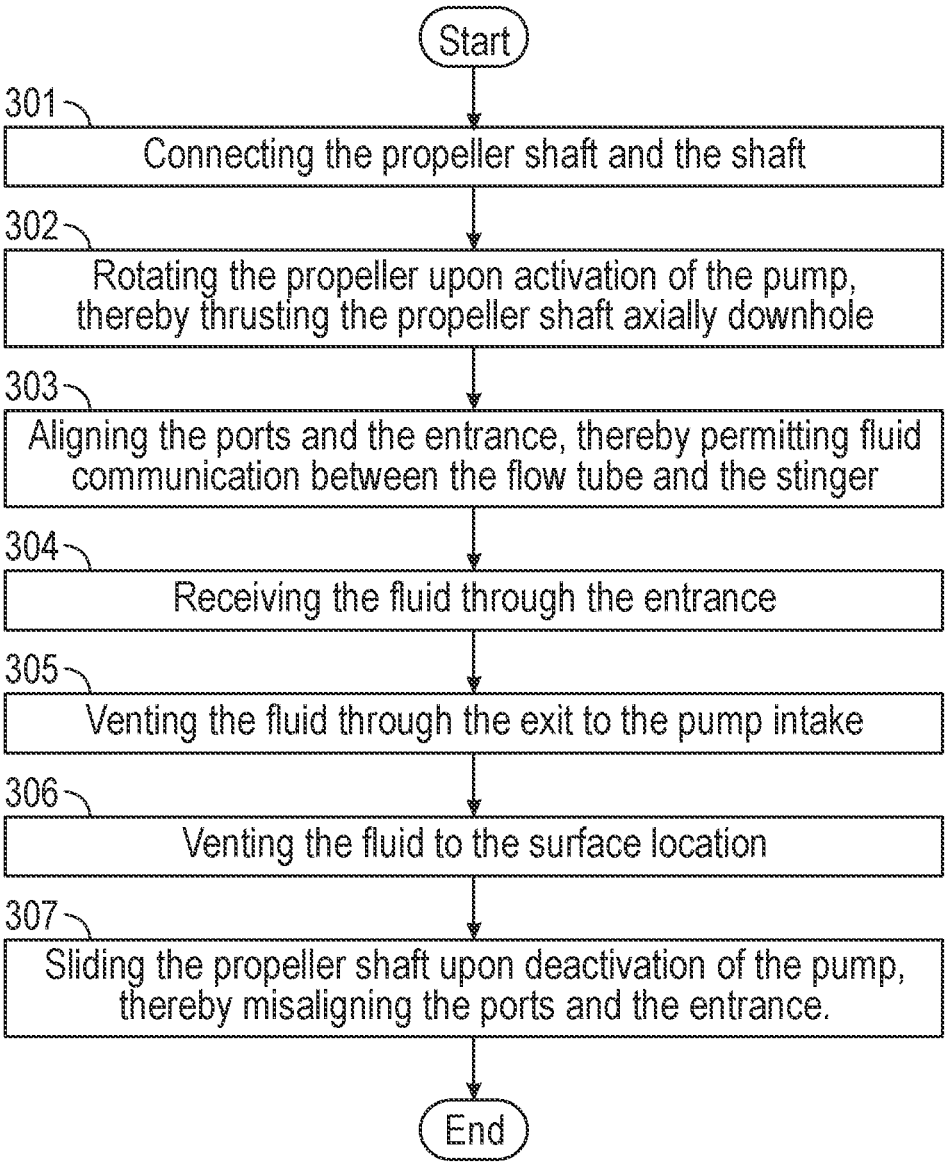
FIG. 8 shows a flowchart of a method in accordance with one or more embodiments of the present disclosure.

FIG. 8 shows a flowchart of a method in accordance with one or more embodiments of the present disclosure. While the various flowchart blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 301, the propeller shaft (160) of the control valve assembly (152) and the shaft (158) of the ESP assembly (154) are coupled by the shaft coupler (164). This may be done at the surface location (114) prior to the system (150) being lowered in the well (116). At the desired depth in the well (116), the system (150) may be strung into a packer (204), in order to prevent fluid recirculation within the system (150).

In block 302, the pump (124) of the ESP assembly (154) is activated, thereby creating a suction force and causing the fluid (102) disposed within the system (150), downhole of the pump (124), to travel towards the pump (124). In addition, the rotation of the shaft (158) of the ESP assembly (154) causes the propeller shaft (160) and the propeller (162) to rotate. Further, as the fluid (102) travels to the pump (124), the fluid (102) passes over the propeller (162), aiding in the rotation of the propeller (162). This rotation thrusts the propeller (162) and the propeller shaft (160) axially downhole along the central axis (176) of the control valve assembly (152). Further, components of the control valve assembly (152) that are fixed to the propeller shaft (160) also travel downhole with the propeller shaft (160).

In block 303, the spring (148) of the control valve assembly (152) is fully compressed by the thrust force upon the propeller shaft (160). In this position, the ports (178) of the flow tube (146) are now aligned with the entrance (172) of the stinger (166). In this way, fluid communication between the flow tube (146) and the conduit of the stinger (166) is established.

In block 304, the fluid (102) disposed within and downhole of the flow tube (146) may flow through the ports (178) of the flow tube (146) into the conduit of the stinger (166) through the entrance (172) of the stinger (166). That is, since the conduit of the stinger (166) and the flow tube (146) are in fluid communication, the fluid (102) within the flow tube (146) experiences the suction force created by the pump (124).

In block 305, the fluid (102) travelling upwards through the conduit of the stinger (166) is vented through the exit (174) of the stinger (166). Upon exiting the conduit of the stinger (166), the fluid (102) flows into the interior of the stinger (166) and enters the pump intake (130) of the ESP assembly (154). Subsequently, the fluid (102) is pumped upwards into the pump (124).

In block 306, the fluid (102) passes through the pump (124), to the pump discharge (156), and is then vented into the casing string (108) of the well (116). Upon exiting the system (150), the fluid (102) travels upwards in the well (116) towards the surface location (114) to be produced.

In block 307, after completion of the pumping operation, the pump (124) is turned off. With the pump (124) no longer active, the suction force created by the pump (124) is diminished, and thus fluid (102) is no longer drawn upwards within the system (150). Consequently, the downward thrust force is reduced and the spring (148) forces the propeller shaft (160) back upwards within the control valve assembly (152). In addition, subsequent to the pump (124) being shut down, the propeller (162) and the propeller shaft (160) may backspin as the fluid flows downhole due to gravity, thereby generating an upward thrust that may assist the spring (148) in moving the propeller shaft (160) upwards in the control valve assembly (152). Accordingly, as the propeller shaft (160) travels upwards in the control valve assembly (152), so does the flow tube (146). In this way, the ports (178) of the flow tube (146) and the entrance (172) of the stinger (166) are no longer aligned. Therefore, fluid communication between the flow tube (146) and the conduit of the stinger (166) is lost. The system (150) may be operated again or removed from the well (116).

Accordingly, the aforementioned embodiments as disclosed relate to systems (150) and methods useful for utilizing a thrust force to operate a control valve assembly (152). The disclosed systems (150) for and methods of operating a control valve assembly (152) with a thrust force advantageously reduce sand accumulation within ESP systems (100). In addition, the disclosed systems (150) and methods may advantageously simplify the operational deployment and retrieval challenges associated with CDESP systems. Specifically, the disclosed systems (150) and methods eliminate the need to run a sperate control line (144) from the surface location (114) in order to activate a conventional SSSV (142) since the valve operations are controlled downhole and not from the surface location (114). Further, complications arise in conventional applications of a shallow-set SSSV (142) with the electrical cable (126) in the production stream which must seal against the flow of fluid (102) to the surface location (114).

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

an electric submersible pump assembly configured to transport a fluid in a casing string of a well to a surface location comprising:

a pump configured to receive the fluid through a pump intake and vent the fluid through a pump discharge when activated; and a shaft extending downhole from and fixed to the pump; and a control valve assembly comprising:

a propeller shaft axially movable along a central axis of the system;

a propeller attached to the propeller shaft, configured to push the propeller shaft downhole when the pump of the electric submersible pump assembly is active;

a shaft coupler connecting the propeller shaft and the shaft of the electric submersible pump assembly;

a stinger having a conduit for the fluid to flow from the casing string to the pump intake, the stinger comprising:

an entrance configured to receive the fluid; and an exit configured to vent the fluid to the pump intake of the electric submersible pump assembly;

a flow tube connected to the propeller shaft, the flow tube comprising ports creating fluid communication between the flow tube and the stinger when the ports and the entrance of the stinger are aligned; and a spring configured to slide the propeller shaft when the pump of the electric submersible pump assembly is inactive.

2. The system according to claim 1, wherein the control valve assembly is disposed downhole of the electric submersible pump assembly.

3. The system according to claim 1, wherein the stinger of the control valve assembly is attached to the pump of the electric submersible pump assembly.

4. The system according to claim 1, further comprising a packer configured to isolate the fluid entering the pump intake from the fluid exiting the pump discharge.

5. The system according to claim 1, wherein the pump intake of the electric submersible pump assembly is disposed downhole of the propeller of the control valve assembly.

6. The system according to claim 1, wherein the control valve assembly further comprises a sand shield configured to prevent sand accumulation within the system.

7. The system according to claim 1, wherein the spring of the control valve assembly is a compression spring.

8. The system according to claim 1, wherein the control valve assembly further comprises:

a bearing configured to support the propeller shaft radially; and a thrust bearing and a thrust runner axially supporting the propeller shaft.

9. The system according to claim 8, wherein the control valve assembly further comprises a housing enclosing the thrust runner, the thrust bearing, and the spring.

10. The system according to claim 9, wherein the control valve assembly further comprises:

a driving magnetic coupler disposed within the housing; and a driven magnetic coupler disposed within the flow tube;

wherein the driving magnetic coupler and driven magnetic coupler are magnetically attracted to one another.

11. The system according to claim 9, wherein the housing contains a barrier fluid configured to provide lubrication to components disposed within the housing.

12. The system according to claim 9, wherein the housing is rigidly fixed to an interior of the stinger.

13. The system according to claim 9, wherein the flow tube is disposed downhole of a first end of the housing.

14. The system according to claim 13, wherein a second end of the housing is disposed within an interior of the flow tube.

15. A method comprising:

connecting, by a shaft coupler, a propeller shaft of a control valve assembly and a shaft of an electric submersible pump assembly;

rotating a propeller by a fluid travelling upwards towards a surface location upon activation of a pump of the electric submersible pump assembly, thereby thrusting the propeller shaft axially downhole along a central axis;

aligning ports of a flow tube and an entrance of a stinger, thereby permitting fluid communication between the flow tube and the stinger;

receiving the fluid through the entrance of the stinger;

venting the fluid through an exit of the stinger to a pump intake of the electric submersible pump assembly;

venting, by a pump discharge of the electric submersible pump assembly, the fluid to a surface location subsequent to receiving the fluid through the pump intake; and sliding, by a spring, the propeller shaft upon deactivation of the pump, thereby misaligning the ports of the flow tube and the entrance of the stinger.

16. The method according to claim 15, further comprising setting a packer within a well between the stinger and a casing string, thereby preventing fluid recirculation.

17. The method according to claim 15, wherein thrusting the propeller shaft axially downhole comprises compressing the spring.

18. The method according to claim 15, wherein thrusting the propeller shaft axially downhole comprises sliding the propeller shaft within the shaft coupler.

19. The method according to claim 15, wherein thrusting the propeller shaft axially downhole comprises pushing the flow tube downhole.

20. The method according to claim 15, wherein receiving the fluid through the entrance of the stinger comprises transporting the fluid towards the exit of the stinger.

* * * * *